US011766873B2

(12) United States Patent
Kohnotoh

(10) Patent No.: US 11,766,873 B2
(45) Date of Patent: Sep. 26, 2023

(54) LIQUID EJECTING APPARATUS, METHOD OF CONTROLLING LIQUID EJECTING APPARATUS, LIQUID TRANSFER APPARATUS, AND METHOD OF CONTROLLING LIQUID TRANSFER APPARATUS

(71) Applicant: CANON KABUSHIKI KAISHA, Tokyo (JP)

(72) Inventor: Atsushi Kohnotoh, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 33 days.

(21) Appl. No.: 17/670,434

(22) Filed: Feb. 12, 2022

(65) Prior Publication Data

US 2022/0258486 A1 Aug. 18, 2022

(30) Foreign Application Priority Data

Feb. 12, 2021 (JP) ..... 2021-020360

(51) Int. Cl.
*B41J 2/175* (2006.01)
*B30B 9/30* (2006.01)
*F04B 43/08* (2006.01)

(52) U.S. Cl.
CPC ..... *B41J 2/17596* (2013.01); *B30B 9/306* (2013.01); *B41J 2/17509* (2013.01); *F04B 43/082* (2013.01)

(58) Field of Classification Search
CPC ..... B41J 2/1714; B41J 2/175; B41J 2/17503; B41J 2/17506; B41J 2/17509;
(Continued)

(56) References Cited

U.S. PATENT DOCUMENTS 6,234,616 B1 5/2001 Komuro ..... 347/85
6,705,712 B2 * 3/2004 Usui ..... B41J 2/16508 347/85

(Continued)

FOREIGN PATENT DOCUMENTS

JP H11-70668 3/1999
JP 2006-248132 9/2006
JP 2015-027741 2/2015

OTHER PUBLICATIONS

U.S. Appl. No. 17/670,433, filed Feb. 12, 2022.
U.S. Appl. No. 17/670,435, filed Feb. 12, 2022.

*Primary Examiner* — Anh T Vo
(74) *Attorney, Agent, or Firm* — Venable LLP

(57) ABSTRACT

A liquid ejecting apparatus includes: a tube configured to establish communication of a flow channel by connecting an ejecting portion configured to eject a liquid to an ejection target medium to a container configured to contain the liquid to be supplied to the ejecting portion; a valve mechanism configured to switch between a close state of pressing and closing the tube and an open state of opening the tube depending on a rotational position of a cam member configured to be rotated by a driving source; and a detection unit configured to detect whether the valve mechanism is in the close state or in the open state. The valve mechanism includes a detection target portion. The detection unit detects whether the valve mechanism is in the close state or in the open state by detecting the detection target portion.

17 Claims, 14 Drawing Sheets

(58) Field of Classification Search
CPC ..... B41J 2/17596; B41J 29/02; B41J 29/13; B30B 9/306; F04B 43/082
See application file for complete search history.

(56) References Cited

U.S. PATENT DOCUMENTS

| | | | | |
|---|---|---|---|---|
| 7,654,656 | B2 * | 2/2010 | Umeda | B41J 2/17509 347/85 |
| 9,090,083 | B2 | 7/2015 | Tsuji | B41J 2/17596 |
| 10,843,481 | B2 | 11/2020 | Shimoyama et al. | B41J 2/17596 |

* cited by examiner

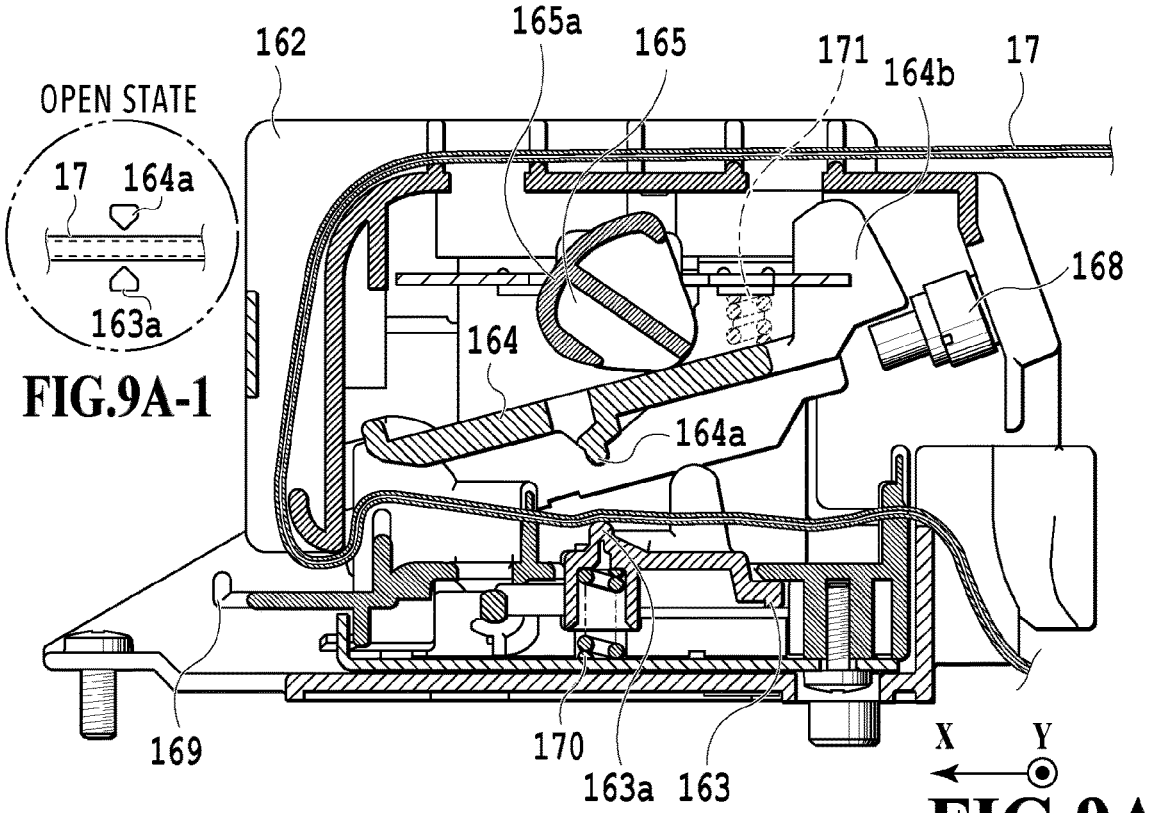
FIG.9A-1
FIG.9A
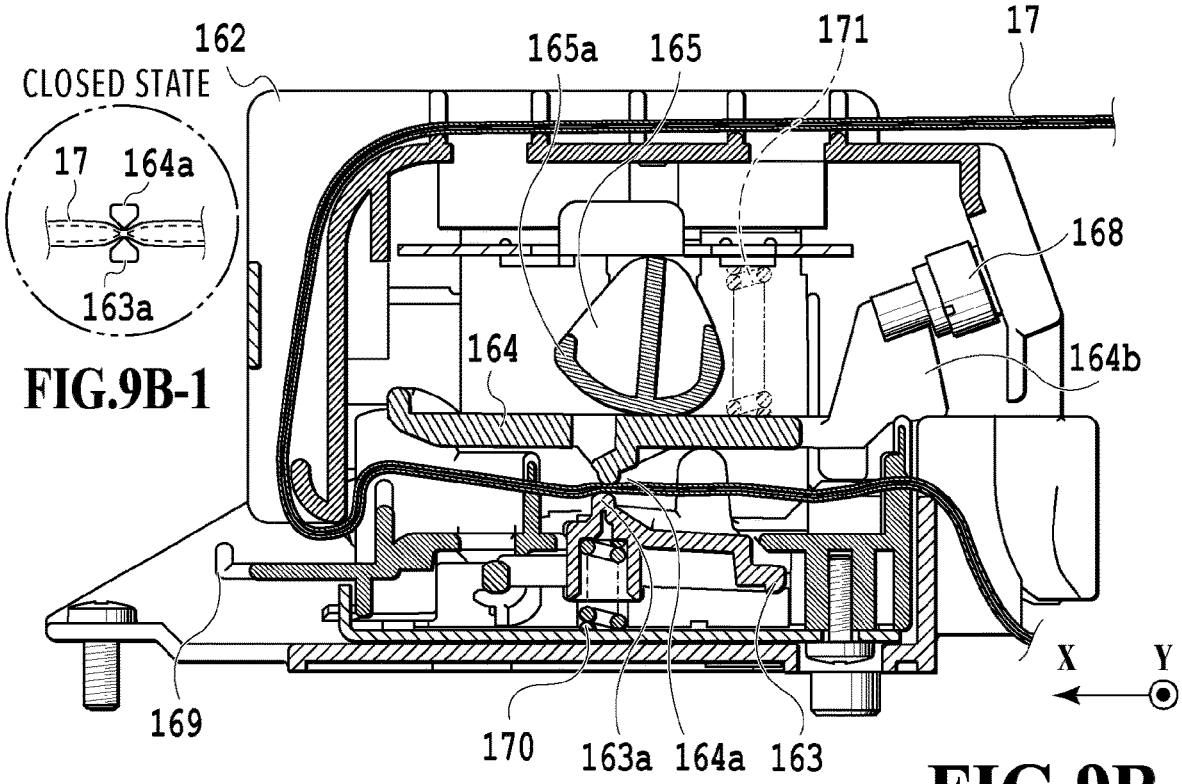
FIG.9B-1
FIG.9B

LIQUID EJECTING APPARATUS, METHOD OF CONTROLLING LIQUID EJECTING APPARATUS, LIQUID TRANSFER APPARATUS, AND METHOD OF CONTROLLING LIQUID TRANSFER APPARATUS

BACKGROUND OF THE INVENTION

Field of the Invention

The present invention relates to a liquid ejecting apparatus, a method of controlling a liquid ejecting apparatus, a liquid transfer apparatus, and a method of controlling a liquid transfer apparatus.

Description of the Related Art

There has been known a printing apparatus configured to use a tube to connect a print head for ejecting an ink to an ink tank containing the ink to be supplied to the print head. In the above-described printing apparatus, the tube is closed for carrying out various operations by crushing the tube with a pressing member. Such a close state is also detected with a sensor.

Japanese Patent Laid-Open No. 2006-248132 (Document 1) discloses a method of detecting a pressed state of a tube based on a rotational position of a driving shaft that drives a pressing member. To be more precise, Document 1 discloses a technique to provide the driving shaft for driving the pressing member with a rotating plate for detection (a sensor flag) having a cutout portion, and to detect a rotational position of the driving shaft by detecting the cutout portion with an optical sensor.

The pressing member may stick to the tube if the tube is kept in the crushed state with the pressing member for a long time due to transportation, blackout, and other reasons. The technique configured to detect the pressed state based on the rotational position of the driving shaft as described in Document 1 may lead to erroneous detection of the open and close states if the tube sticks to the pressing member.

SUMMARY OF THE INVENTION

A liquid ejecting apparatus according to one aspect of the present invention includes: a tube configured to establish communication of a flow channel by connecting an ejecting portion configured to eject a liquid to an ejection target medium to a container configured to contain the liquid to be supplied to the ejecting portion; a valve mechanism configured to switch between a close state of pressing and closing the tube and an open state of opening the tube depending on a rotational position of a cam member configured to be rotated by a driving source; and a detection unit configured to detect whether the valve mechanism is in the close state or in the open state. Here, the valve mechanism includes a detection target portion, and the detection unit detects whether the valve mechanism is in the close state or in the open state by detecting the detection target portion.

Further features of the present invention will become apparent from the following description of exemplary embodiments with reference to the attached drawings.

BRIEF DESCRIPTION OF THE DRAWINGS

FIGS. 9A and 9B are cross-sectional views showing the outline of the on-off valve mechanism;

FIG. 9A-1 is an enlarged view of the vicinity of a pressing portion 164*a* and a contact portion 163*a* in FIG. 9A;

FIG. 9B-1 is an enlarged view of the vicinity of a pressing portion 164*a* and a contact portion 163*a* in FIG. 9B;

DESCRIPTION OF THE EMBODIMENTS

Embodiments of the present invention will be described below with reference to the drawings. It is to be noted that the following embodiments do not intend to limit the scope of the present invention and that all the combinations of the features described in the embodiments are not always essential. The same constituents in the embodiments will be denoted by the same reference signs in the following description.

In the present specification, the term "printing" (which may also be referred to as "print") is not limited to a case of forming significant information such as characters and graphics, but encompasses formation of all significant and insignificant information. This term is also assumed to broadly include formation of images, figures, patterns, and the like on a print medium as well as processing of a print medium regardless of whether or not these objects are materialized so as to be discernible to human eyes.

Meanwhile, the term "ink" (which may also be referred to as "liquid") should also be interpreted in a broad sense as with the definition of the "printing" mentioned above. Accordingly, this term is assumed to represent a liquid which serves to form images, figures, patterns, and the like, to process a print medium, and to modify an ink (such as coagulation and insolubilization of a colorant contained in the ink to be applied to the print medium) in the case where the liquid is applied onto the print medium.

In addition, the term "print medium" not only includes paper used in general printing apparatuses but also broadly includes media that can accept the ink as typified by cloth, plastic films, metal plates, glass, ceramics, wood, leather, and the like.

First Embodiment

<Configuration of Printing Apparatus>

Figure 1:
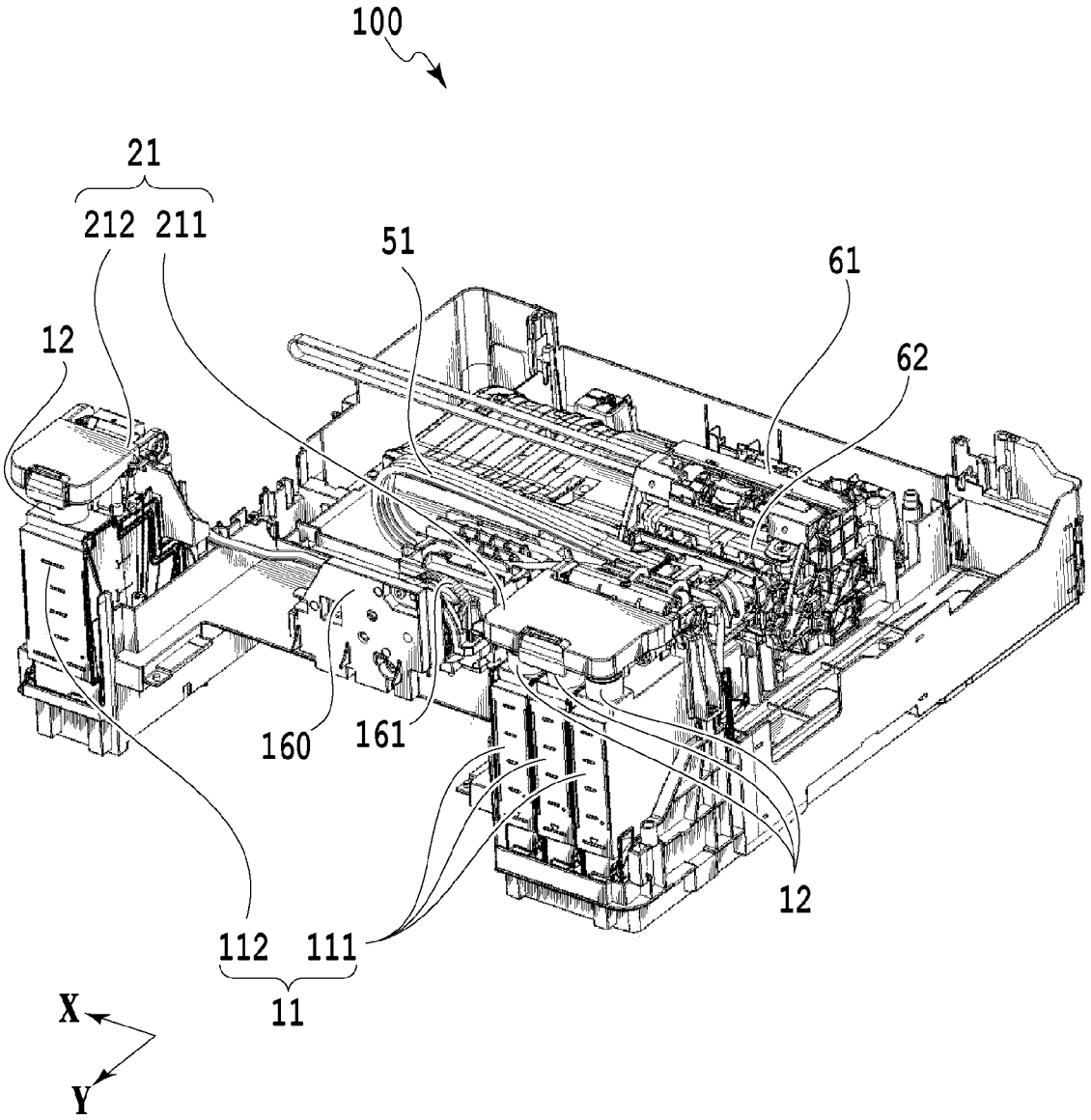
FIG. 1 is a perspective view showing a printing apparatus.

FIG. 1 is a perspective view showing a printing apparatus 100 that represents an example of a liquid ejecting apparatus of the present embodiment. FIG. 1 shows a partial configuration of the printing apparatus 100. The printing apparatus 100 includes ink tanks 11 that contain inks, a print head 62 that ejects the inks supplied from the ink tanks 11 through ink supply channels 51, and a carriage 61 that holds the print head 62. The carriage 61 is configured to scan a print medium (not shown) in a direction orthogonal to a direction of transportation of the print medium, and an image is printed on the print medium by a combination of scanning by the carriage 61 and ejection from the print head 62.

Although the present embodiment describes an example of the printing apparatus, the same applies to a case of a liquid ejecting apparatus. For example, such a liquid ejecting apparatus may include a liquid container that contains a liquid, a liquid ejecting unit that ejects the liquid supplied from the liquid container through a liquid supply channel, and a liquid ejecting unit holder that holds the liquid ejecting unit. The description will be given in the present embodiment by using the printing apparatus 100 as the example of the liquid ejecting apparatus.

Each ink tank 11 may be a first ink tank 111 or a second ink tank 112. The present embodiment shows the case of providing the multiple first ink tanks 111 on the assumption of a case of using multiple types of inks. However, in the case of using a single type of the ink, a single ink tank (such as the first ink tank 111) may only be provided. Meanwhile, the second ink tank 112 having a larger capacity than that of the first ink tank 111 may be provided in the case of using a large amount of the ink. Without limitations to the foregoing, only the second ink tanks 112 may be provided or the first ink tanks 111 and the second ink tank 112 may be provided as in the present embodiment. In the case of providing two or more ink tanks 11, the ink tanks 11 may be provided on the right and the left relative to the center of the apparatus depending on the size of the printing apparatus 100, or provided only on one side. In the present embodiment, three color ink tanks 111 that can contain cyan ink, magenta ink, and yellow ink, respectively, are provided as the first ink tanks 111. Meanwhile, one black ink tank 112 that can contain black ink is provided as the second ink tank 112. Configurations of other components shown in FIG. 1 will be described later.

The printing apparatus 100 includes feeding rollers (not shown) that feed the print media, transportation rollers (not shown) that transport the print media, and discharge rollers (not shown) that discharge the print media. The print head 62 is detachably mounted on the carriage 61 and configured to eject the inks onto a surface of a print medium transported by the transportation rollers, thus printing an image thereon. Moreover, the printing apparatus 100 includes an ink suction mechanism 64 (see FIG. 4B) provided with a suction cap 65. In order to recover an ejection performance of the print head 62, the printing apparatus 100 brings the suction cap 65 into contact with the print head 62, and suctions the inks from ink ejection ports 63 (see FIG. 4B) of the print head 62 by using the ink suction mechanism 64. Here, the ink suction mechanism 64 includes a tube connected to the suction cap 65, and a suction pump serving as a suctioning unit, for example.

The present embodiment describes an example in which the print head 62 ejects the inks in accordance with a movement associated with scanning by the carriage. However, the present invention is not limited only to this configuration. The print head may be of a so-called line type, which is provided with ink ejection ports in a region corresponding to a width of the print medium and configured to print images on the print medium without scanning by the carriage.

Figure 2:
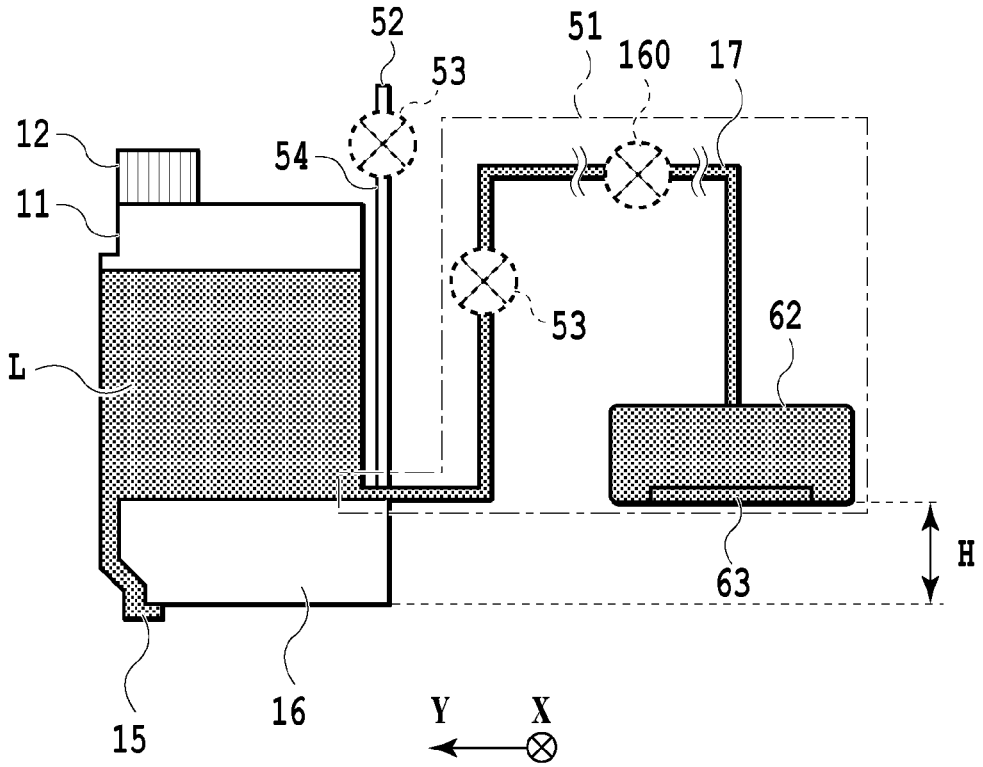
FIG. 2 is a schematic diagram showing a positional relation between an ink tank and a print head.

FIG. 2 is a schematic diagram showing a positional relation between the ink tank 11 and the print head 62. A supply tube 17 constituting the ink supply channel 51 for supplying the ink to the print head 62 is attached to the ink tank 11. Moreover, a tube constituting an atmospheric communicating channel 54 to establish communication of the inside of the ink tank 11 (a buffer chamber 16) with the atmosphere is connected to the ink tank 11. The supply tube 17 is formed from a flexible material (an elastic member) such as an elastomer or silicon. Valve units 53 for blocking communication of a liquid or the air are provided at a portion of the ink supply channel 51 between the ink tank 11 and the print head 62 and at a portion of the atmospheric communicating channel 54 between the ink tank 11 and an atmosphere communicating opening 52, respectively.

The valve units 53 include a black side valve unit and color side valve units. The black side valve unit closes the ink supply channel 51 and the atmospheric communicating channel 54 connected to the black ink tank 112, respectively. The color side valve units close the ink supply channels 51 and the atmospheric communicating channels 54 connected to the color ink tanks 111, respectively. In the meantime, an on-off valve mechanism 160 to shut off the communication of the liquid or the air is provided at a portion of each ink supply channel 51 between the valve unit 53 and the print head 62. The on-off valve mechanisms 160 include a black side on-off valve mechanism and color side on-off valve mechanisms. The black side on-off valve mechanism closes the ink supply channel 51 connected to the black ink tank 112. The color side on-off valve mechanisms close the ink supply channels 51 connected to the color ink tanks 111, respectively. Each on-off valve mechanism 160 includes various components. Here, the black side on-off valve mechanism and the color side on-off valve mechanisms may use the same components in common or use different components from each other. Details of the on-off valve mechanisms will be described later. Differences in role between the on-off valve mechanism 160 and the valve unit 53 will also be described later.

In the printing apparatus 100 of the present embodiment, a liquid-gas replacement portion 15 of the ink tank 11 is located at a position lower by an amount H in a height direction than the ink ejection ports 63 of the print head 62 in order to prevent a leakage of the ink from the ink ejection ports 63 of the print head 62. In other words, a negative pressure originating from a water head difference corresponding to the height H is applied to the ink ejection ports 63. Meanwhile, the buffer chamber 16 is provided at a lower part of the ink tank 11. The buffer chamber 16 can store the ink to be pushed out in the case of destruction of a meniscus in the liquid-gas replacement portion 15 due to expansion of the air inside the ink tank 11 caused by an atmospheric pressure variation or a change in temperature. Thus, it is possible to suppress the leakage of the ink from the ink tank 11 through the atmospheric communicating channel 54. In FIG. 2 as well as FIGS. 4A and 4B to be described later, an open state of each of the valve units 53 and the on-off valve mechanism 160 is indicated with a dashed line and a close state thereof is indicated with a solid line.

Next, a configuration of an ink supply system and a flow from a point of injection of the ink to a point to enable image printing in the present embodiment will be described with reference to FIGS. 3A to 5. FIGS. 3A to 3D are perspective views of the printing apparatus 100 according to the present embodiment. FIGS. 3A to 3D are the perspective views illustrating a process of transition from a state in FIG. 3A to a state in FIG. 3D in which a user can inject the ink into the ink tank 11. FIGS. 4A and 4B are schematic diagrams showing states of the ink tank 11 and the print head 62 according to the present embodiment.

Figure 3A:
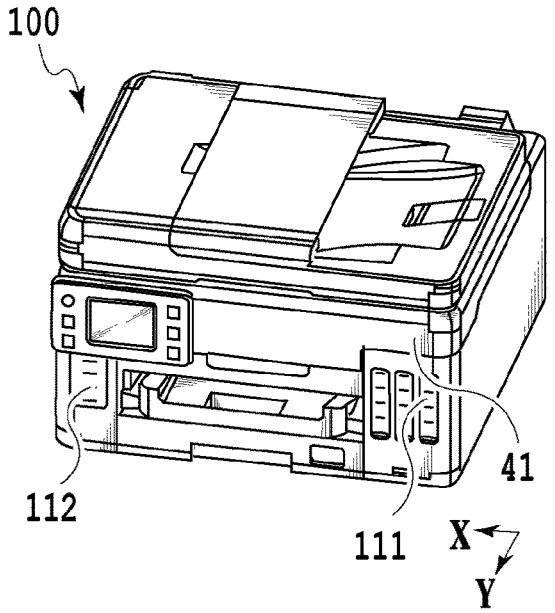
FIGS. 3A to 3D are perspective views of the printing apparatus.
Figure 4A:
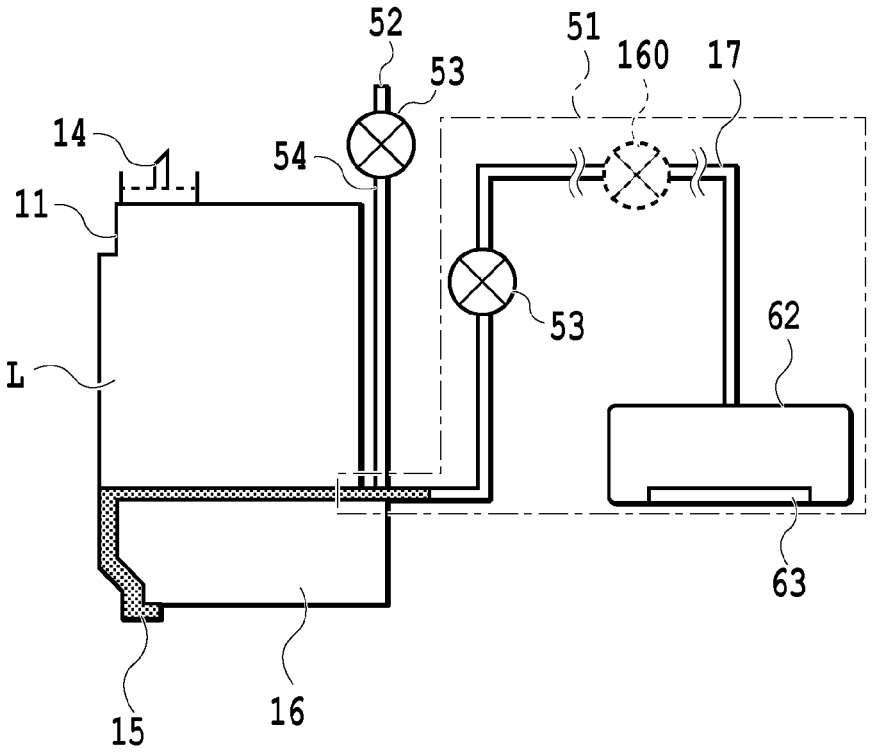
FIGS. 4A and 4B are schematic diagrams showing states of the ink tank and the print head.
Figure 4B:
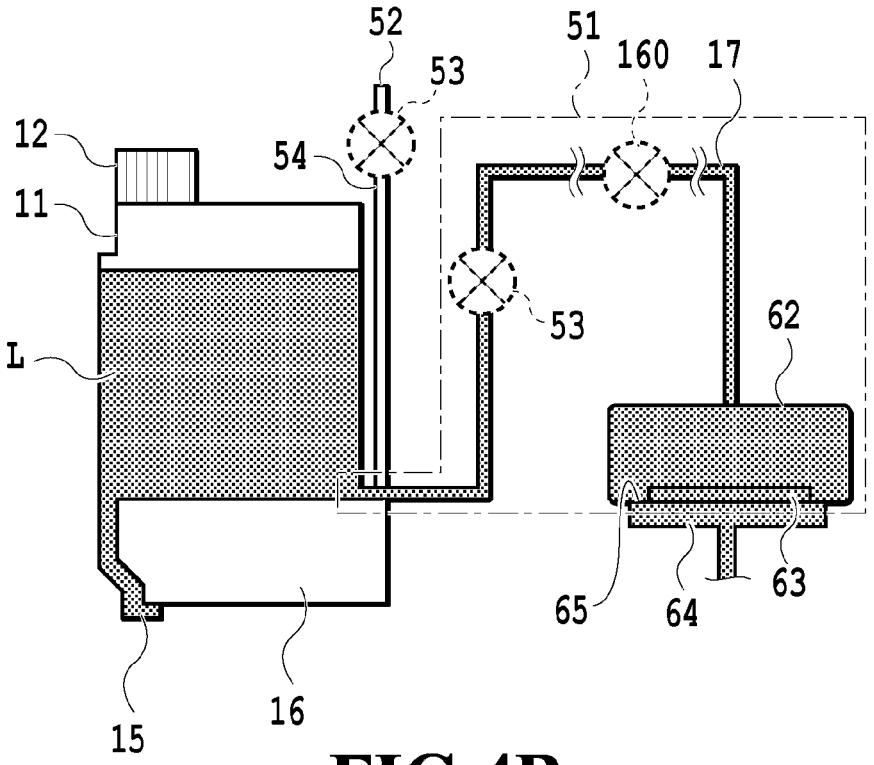

As shown in FIG. 3A, the printing apparatus 100 includes a third cover member 41, which is provided with a mechanism for reading an image on a loaded original document and is pivotally supported by the printing apparatus 100 in an openable and closable manner. Note that the third cover member 41 may be a reading mechanism to read the image on the original, or may be an access cover constituting an external upper surface which exposes part of internal components of the printing apparatus 100 in order to remove the print medium that causes a transportation failure in the course of image printing. The ink tank 11 is installed on a front surface side (+y direction side) of the printing apparatus 100 so that the user can easily inject the ink into the ink tank 11. As described above, the four ink tanks 11 in total, namely, the three color ink tanks 111 and the black ink tank 112 are provided in present embodiment. However, the types and the number of the ink tanks 11 are not limited to this example. For instance, more than four ink tanks 11 may be provided in order to improve quality of image printing on the print medium.

Figure 3B:
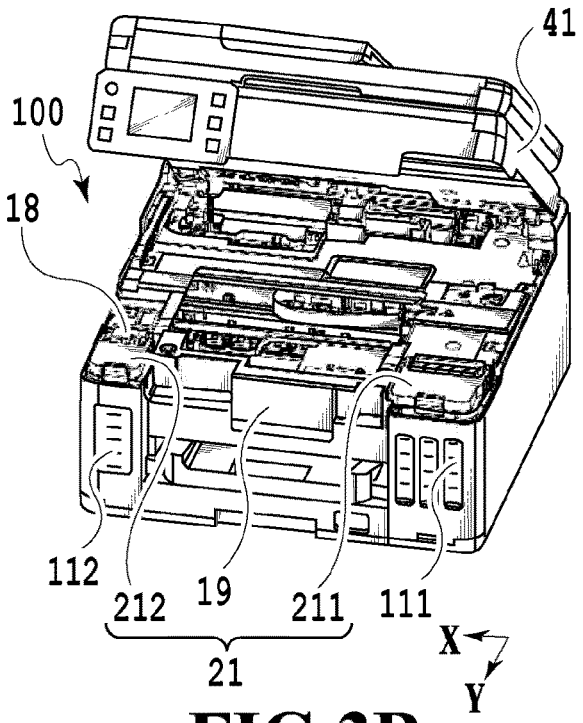

In the case where the user injects the ink into the ink tank 11, the user first turns the third cover member 41 upward and sets the third cover member 41 to the open state as shown in FIG. 3B. As the third cover member 41 is turned by a predetermined amount, the open state of the third cover member 41 can be maintained by use of a lock mechanism (not shown). Here, a cover sensor 18 is installed at a housing 19 and is capable of detecting the open state or the close state of the third cover member 41. The cover sensor 18 is not limited to a mechanical sensor designed to detect mechanical contact. The cover sensor 18 may be may be an optical sensor, for example. Here, it is possible to release the lock mechanism by further turning the third cover member 41 upward. This action makes it possible to close the third cover member 41. By opening the third cover member 41, the internal components of the printing apparatus 100 are exposed and the user can operate a second cover member 21 (see FIGS. 3B and 1).

The second cover member 21 is pivotally supported in such a way as to be movable between a position to fall forward (a closed lid position) and a position to be lifted up (an open lid position). The ink tanks 11 are provided with the second cover members 21, respectively. To be more precise, the black ink tank 112 is covered with a black second cover member 212 and the three color ink tanks 111 are integrally covered with a single color second cover member 211. The black second cover member 212 and the color second cover member 211 will be collectively referred to as the second cover member 21. Although the black second cover member 212 and the color second cover member 211 are formed into different shapes in present embodiment, these cover members may be formed into the same shape instead.

Figure 3C:
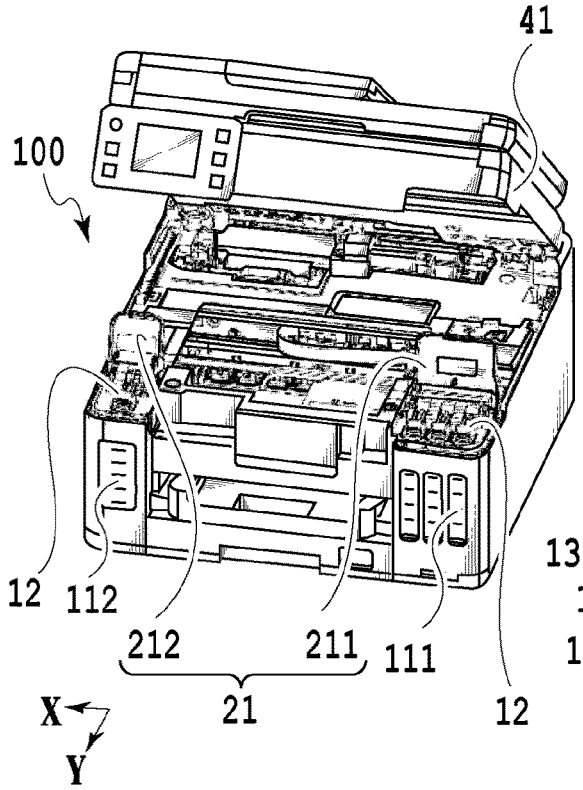
Figure 3D:
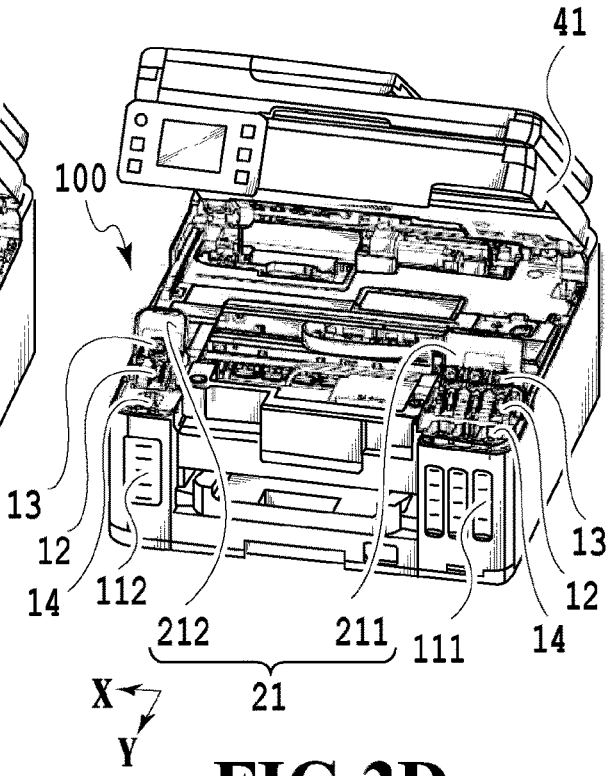

A first cover member 12 to close the ink tank 11 appears in the case where the user operates the second cover member 21 from the closed lid position to the open lid position (see FIGS. 1, 3C, and 4B). The first cover member 12 is pivotally supported in such a way as to be movable between a position to close the ink tank 11 (a closed tap position) and a position to be lifted up (an open tap position). An injection port 14 provided at an upper part of the ink tank 11 for user in injecting the ink appears in the case where the user operates the first cover member 12 from the closed tap position to the open tap position (see FIGS. 3D and 4A).

The first cover member 12 is provided with a seal member 13 formed from an elastic body such as rubber. By operating the first cover member 12 to the closed tap position, the seal member 13 closes the injection port 14 so as to prevent the leakage of the ink contained in the ink tank 11. In the present embodiment, the valve unit 53 acts in conjunction with the operation to lift the first cover member 12, thus closing the ink supply channel 51 and the atmospheric communicating channel 54, respectively (FIG. 4A).

The user can inject the ink into the ink tank 11 by putting a container (not shown) containing the ink into the injection port 14. After the injection of the ink is completed, the user operates the first cover member 12 to the closed tap position again. The valve unit 53 acts in conjunction with this operation, thus opening the ink supply channel 51 and the atmospheric communicating channel 54, respectively (see FIG. 4B). Thereafter, the user operates the second cover member 21 to the closed lid position, thus closing the third cover member 41. The printing apparatus 100 can detect the closure of the third cover member 41 by using the cover sensor 18 configured to detect the position of the third cover member 41. Upon detection of the closure of the third cover member 41, the printing apparatus 100 brings the suction cap 65 into contact with the print head 62 as shown in FIG. 4B in order to fill the ink supply channel 51 with an ink L inside the ink tank 11. Then, the ink suction mechanism 64 carries out a suctioning operation to suction the ink L from the ink ejection ports 63. The supply tube 17 constituting the ink supply channel 51 is filled with the ink as a consequence of this suctioning operation. Moreover, it is possible to conduct the suctioning operation while applying a larger negative pressure to the ink ejection ports 63 by carrying out on-off control of the on-off valve mechanism 160 at the time of this suctioning operation. To be more precise, the suction pump of the ink suction mechanism 64 is driven in the state of capping the print head 62 with the suction cap 65 while closing the on-off valve mechanism 160. In this way, the negative pressure is charged between the on-off valve mechanism 160 and the ink ejection ports 63 of the print head 62. Then, as the suction pump is stopped and the on-off valve mechanism 160 is opened, the print head 62 is filled with the ink by means of the charged negative pressure. In the meantime, the on-off valve mechanism 160 also has a role in closing the ink supply channel 51 so as to block the ink leakage in the case of moving the printing apparatus 100.

As described above, the ink supply channel 51 is provided with the two types of the valves in the present embodiment, namely, the valve unit 53 and the on-off valve mechanism 160, which have the functions independent of and different from each other. Specifically, the valve unit 53 closes the ink supply channel 51 in the case of filling the ink tank 11 with the ink and opens the ink supply channel 51 in other cases. On the other hand, the on-off valve mechanism 160 closes the ink supply channel 51 in order to suppress the ink leakage or in the case of conducting efficient suctioning at the time of filling the ink. Details of the on-off valve mechanism 160 will be described later.

In the state filled with the ink as described above, as the ink is ejected from the ink ejection ports 63 in the case of printing an image on the print medium, for example, the ink is supplied from the ink tank 11 to the print head 62 in an amount equivalent to an amount of the ink discharged from the print head 62. The ink is continuously supplied from the ink tank 11 to the print head 62 until the ink in the ink tank 11 falls below a predetermined amount.

The above-described example has explained the case where the user conducts the opening and closing operations by operating the first cover member 12, the second cover member 21, and the third cover member 41. Instead, the opening and closing operations may be carried out automatically by means of control inside the printing apparatus 100.

<Ink Filling Sequence>

Figure 5:
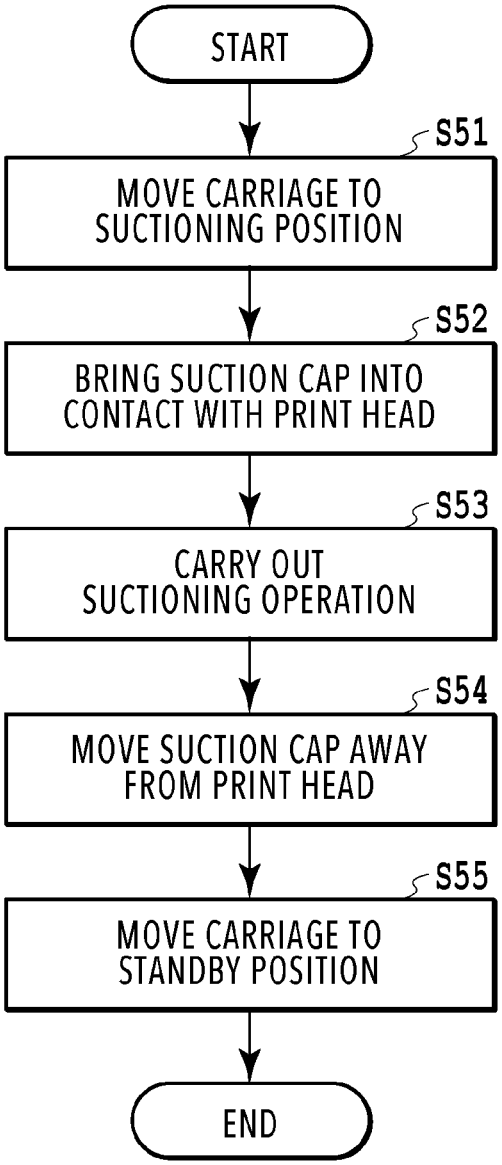
FIG. 5 is a flowchart of an ink filling sequence.

FIG. 5 is a flowchart of an ink filling sequence. In the case where the ink filling sequence is started, the printing apparatus 100 moves the carriage 61 that holds the print head 62 to a suctioning position opposed to the suction cap 65 in S51 to begin with. In S52, the printing apparatus 100 brings the suction cap 65 into contact with the print head 62. In S53, the printing apparatus 100 carries out the suctioning operation to suction the ink from the ink ejection ports 63 of the print head 62 by using the suction cap 65. In this instance, the suctioning operation may be carried out together with the on-off control of the on-off valve mechanism 160 as discussed earlier. After the completion of the suctioning operation, the printing apparatus 100 moves the suction cap 65 away from the print head 62 in S54. Then, in S55, the printing apparatus 100 moves the carriage 61 from the suctioning position to a standby position. Thus, the operations of the series of the ink filling sequence are terminated.

<Block Diagram>

Figure 6:
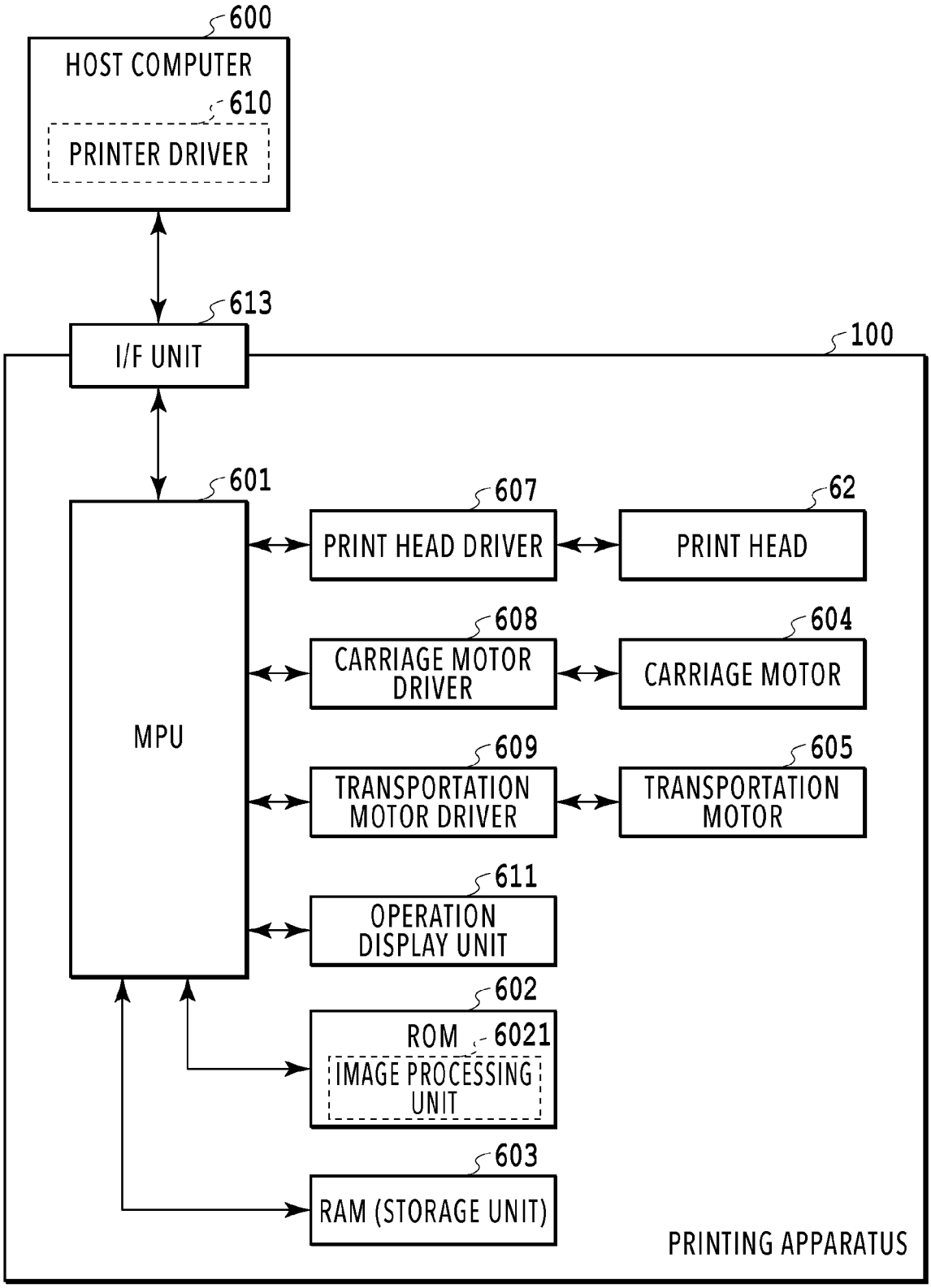
FIG. 6 is a block diagram including a configuration of the printing apparatus.

FIG. 6 is a block diagram including a configuration of the printing apparatus 100 according to the present embodiment. The printing apparatus 100 includes the print head 62, an MPU 601, a ROM 602, a RAM 603, a carriage motor 604, a transportation motor 605, a print head driver 607, a carriage motor driver 608, a transportation motor driver 609, and an I/F unit 613. A program that functions as an image processing unit 6021 is stored in the ROM 602.

The MPU 601 controls operations of the respective units, data processing, and the like. The ROM 602 stores programs and data to be executed by the MPU 601. The RAM 603 temporarily stores processing data to be executed by the MPU 601 and data received from a host computer 600. The print head 62 is controlled by the print head driver 607. The carriage 61 is driven by the carriage motor 604. The carriage motor 604 is controlled by the carriage motor driver 608. The feeding rollers, the transportation rollers, and the discharge rollers are driven by the transportation motor 605. The transportation motor 605 is controlled by the transportation motor driver 609. The host computer 600 includes a printer driver 610 for processing print information such as a printed image and image quality and for communicating with the printing apparatus 100 in the case where the user issues a command to execute a printing operation. The MPU 601 exchanges printed images and the like with the host computer 600 through the I/F unit 613.

<Configuration of On-Off Valve Mechanism>

Figure 7A:
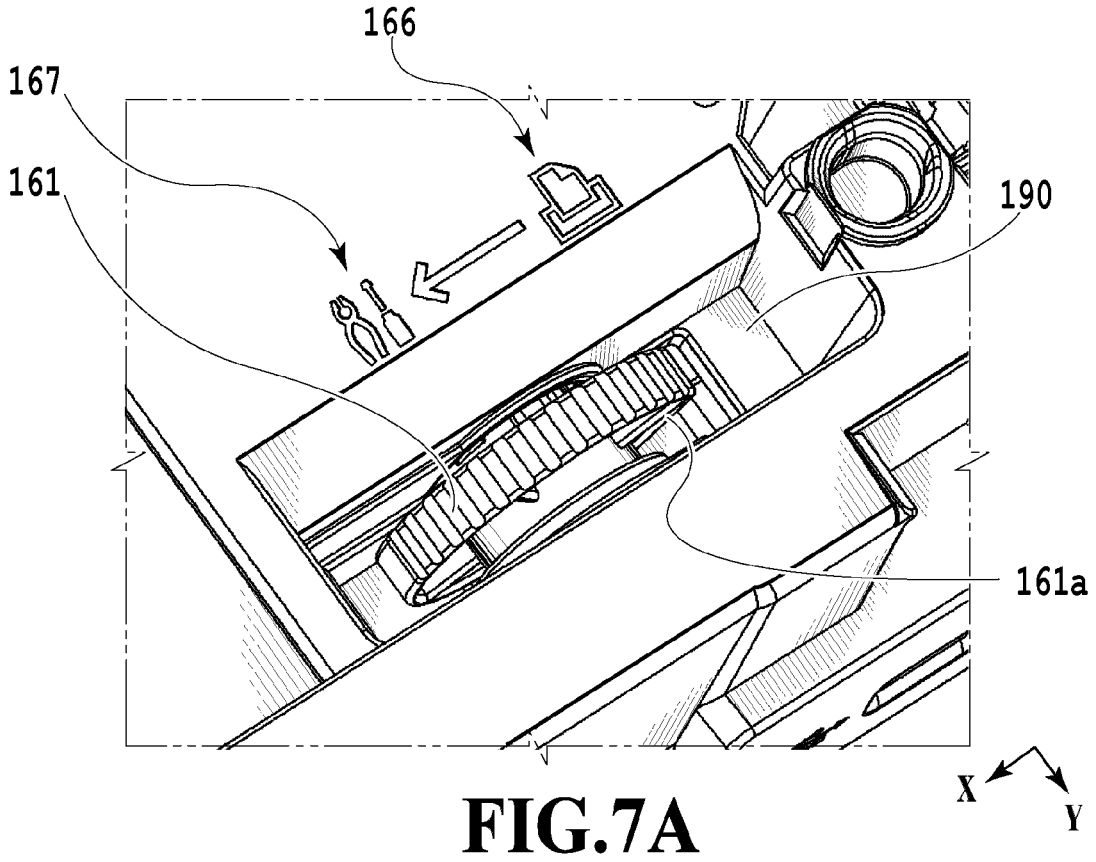
FIGS. 7A and 7B are perspective views of an operating unit in an on-off valve mechanism.
Figure 7B:
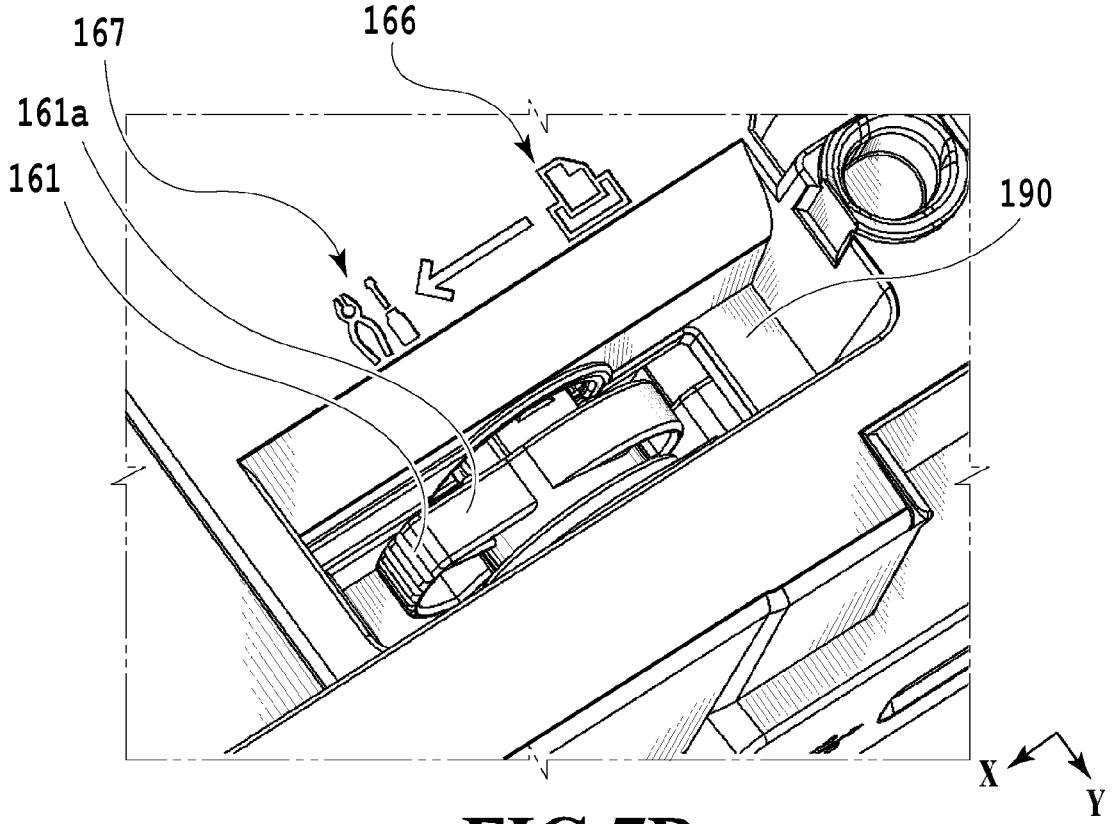
Figure 8:
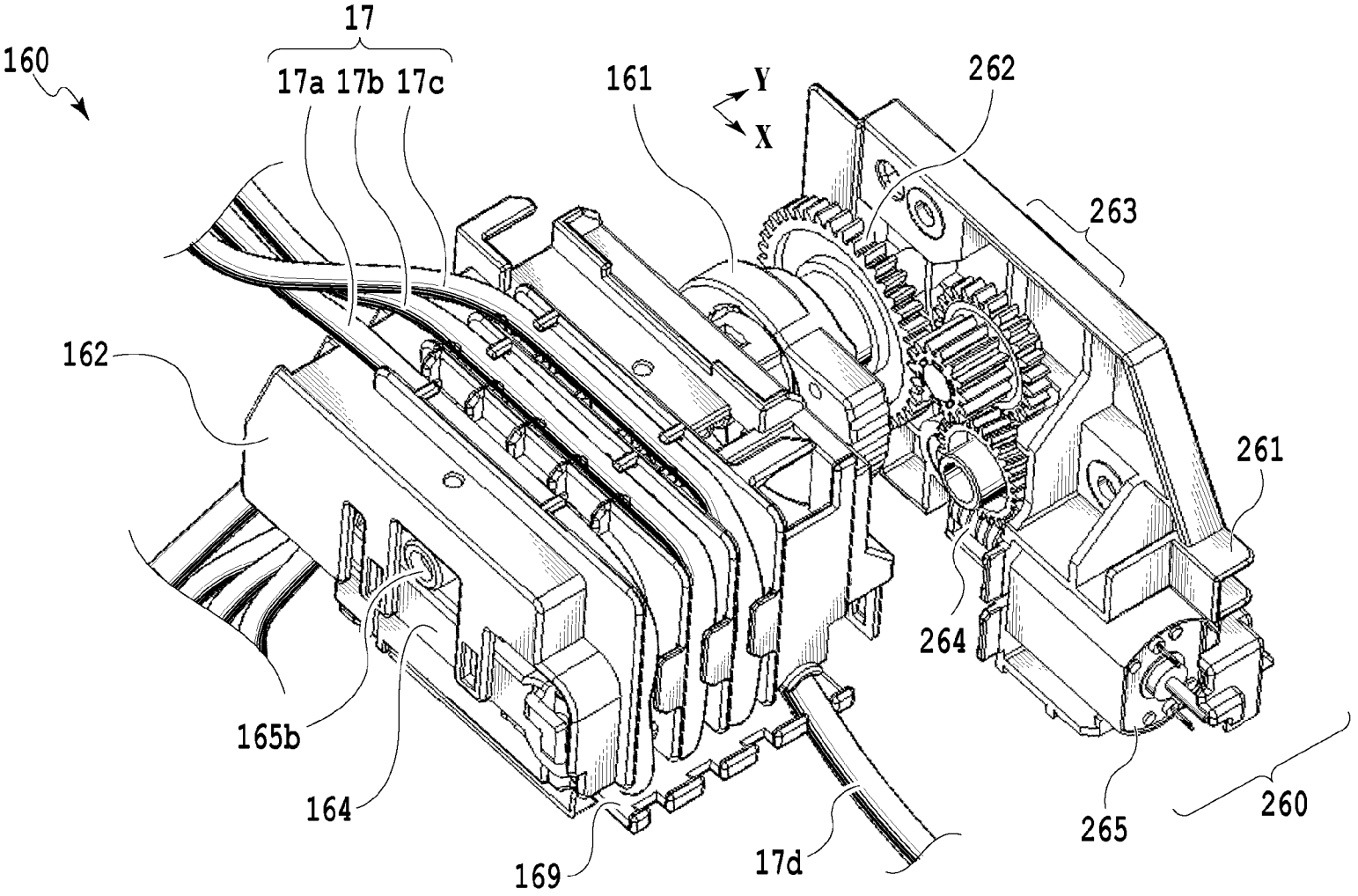
FIG. 8 is a perspective view showing an outline of the on-off valve mechanism.
Figure 10A:
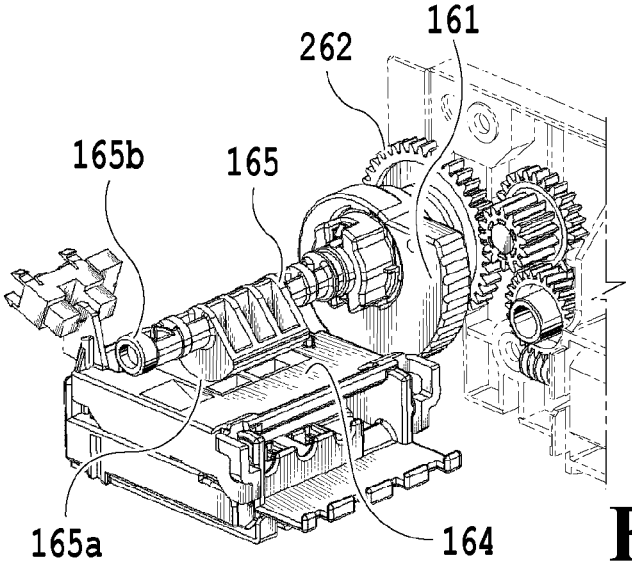
FIGS. 10A to 10C are perspective views of the on-off valve mechanism in a state of removing a cover member therefrom.
Figure 10B:
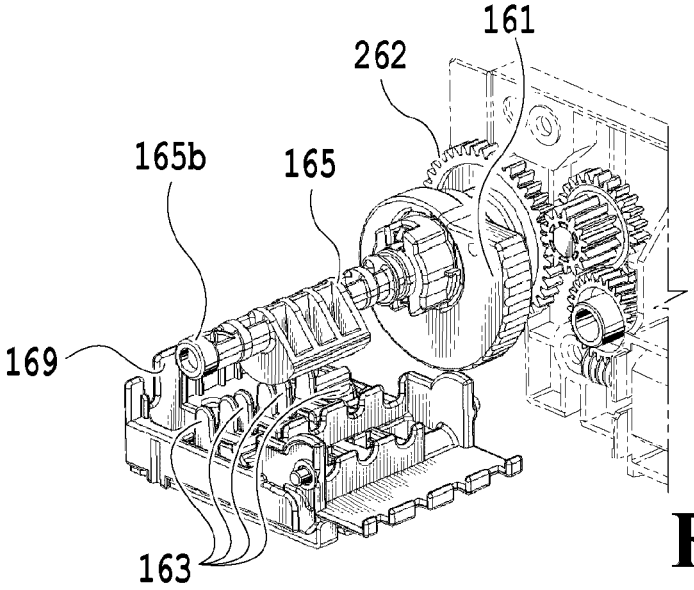
Figure 10C:
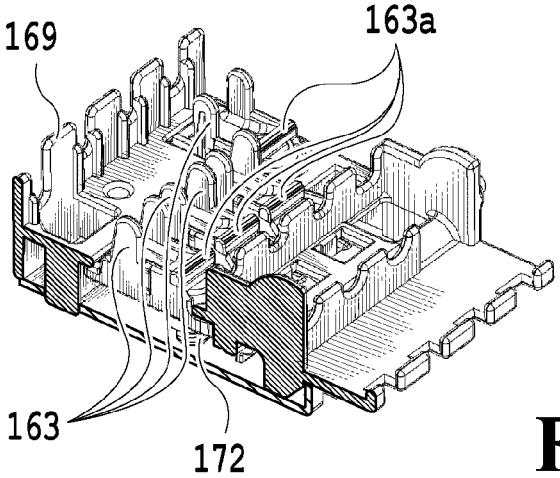
Figure 11:
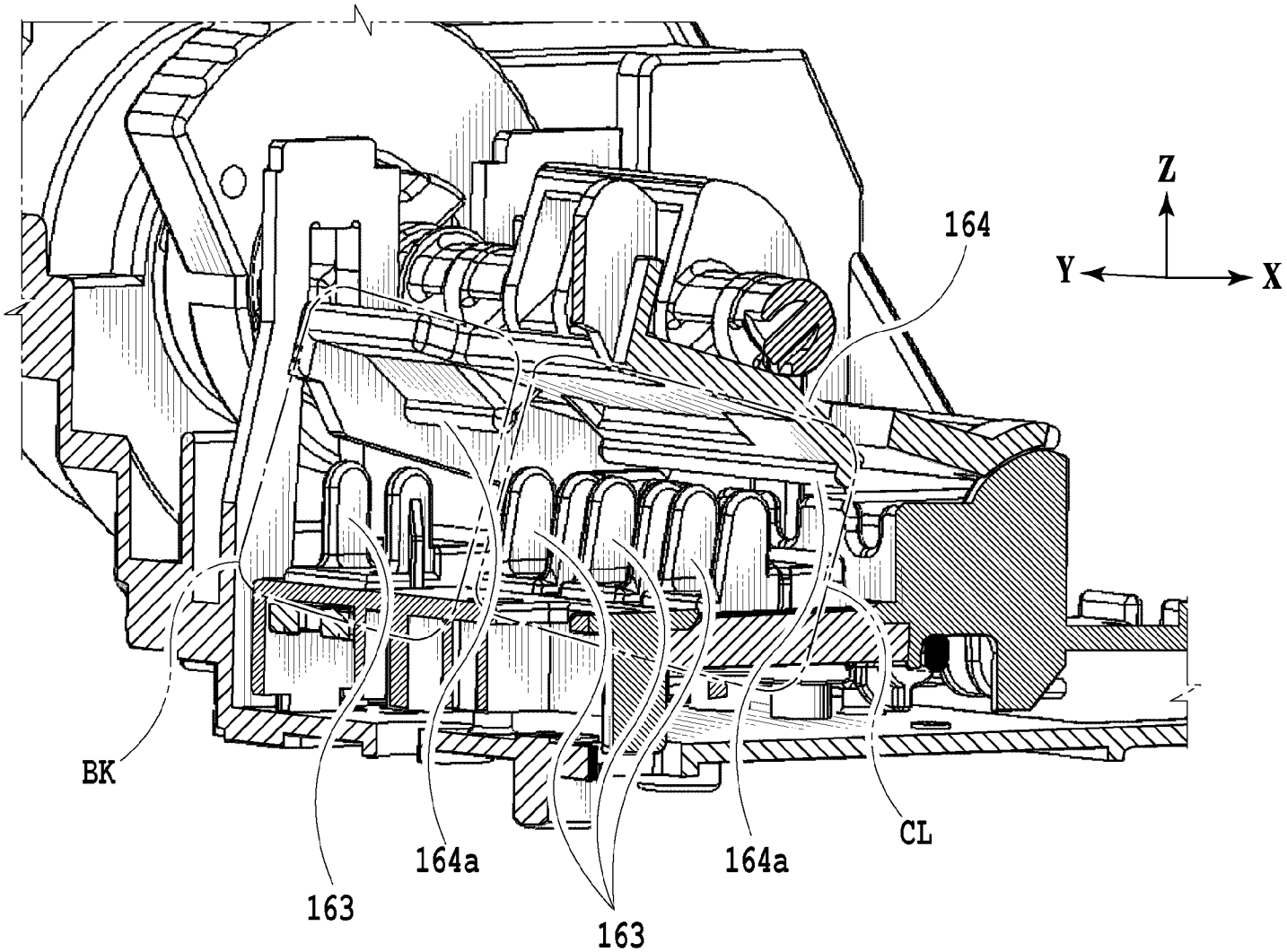
FIG. 11 is a perspective view of the on-off valve mechanism.

Next, a description will be given of a configuration and operations of the on-off valve mechanism 160 according to the present embodiment. FIGS. 7A and 7B are perspective views of an operating unit 161 in the on-off valve mechanism 160 according to the present embodiment. FIG. 8 is a perspective view showing an outline of the on-off valve mechanism 160 according to the present embodiment. FIGS. 9A and 9B are cross-sectional views showing the outline of the on-off valve mechanism 160 according to the present embodiment. FIGS. 10A to 10C are perspective views of the on-off valve mechanism 160 in a state of removing a cover member 162 therefrom. FIG. 11 is a perspective view of the on-off valve mechanism 160 from a different viewpoint from that of FIG. 8. The following description will be given mainly with reference to FIGS. 7A to 11 as appropriate.

As described above, the on-off valve mechanism 160 is the valve for closing and opening (establishing communication of) the ink supply channel 51 formed from the supply tube 17. As shown in FIGS. 1, 7A, 7B, and 8, the on-off valve mechanism 160 includes the operating unit 161 which is manually operable by the user. The on-off valve mechanism 160 is disposed at the ink supply channel 51 and is capable of switching between an open state to establish communication between the ink tank 11 and the print head 62 and a close state to block the communication by operating the operating unit 161. Moreover, as shown in FIGS. 7A and 7B, a print mark 166 and a maintenance mark 167 are drawn at operating positions of the operating unit 161 so as to enable the user to intuitively recognize on-off states of a valve in the on-off valve mechanism 160. The on-off valve mechanism 160 according to the present embodiment enables opening and closing operations manually and automatically by coupling a driving unit thereto. Here, the driving unit can be electrically driven by an external power supply. In other words, the operating unit 161 can switch between the open state and close state by driving the external driving unit in addition to the manual operation of the user.

As shown in FIG. 3B, the printing apparatus 100 includes the housing 19. Moreover, as shown in FIGS. 7A and 7B, the housing 19 includes an opening portion 190. The operating unit 161 is disposed in the opening portion 190. Meanwhile, since the cover sensor 18 (FIG. 3B) is provided in the present embodiment, the printing apparatus 100 can detect by using the cover sensor 18 as to whether or not the operating unit 161 is in a state operable by the user.

In addition to the operating unit 161 operable by the user, the on-off valve mechanism 160 includes the cover member 162, a receiving member 163, a displacement member 164, a cam 165 (a cam member), a holding member 169, and a driving mechanism 260 as shown in FIGS. 8 to 11. FIG. 9A shows the open state of the on-off valve mechanism 160 and FIG. 9B shows the close state of the on-off valve mechanism 160. FIG. 10A is a diagram showing a state after removing the cover member 162 that appears in FIG. 8. FIG. 10B is a diagram showing a state after removing the displacement member 164 that appears in FIG. 10A. FIG. 10C is a diagram showing a state after removing the receiving member 163 that appears in FIG. 10B.

The cover member 162 and the holding member 169 hold the supply tubes 17 as shown in FIGS. 8 to 9B. One end of each supply tube 17 is connected to the print head 62 while the other end thereof is connected to the corresponding ink tank 11. The supply tube 17 includes a bending region which is bendable along with the movement of the print head 62. The on-off valve mechanism 160 is arranged such that the bendable region of the supply tube 17 is located between the print head 62 and the cover member 162. In other words, the on-off valve mechanism 160 is disposed at a region of each supply tube 17 which does not move along with the movement of the carriage 61.

As shown in FIGS. 9A, 9B, and 11, the displacement member 164 is a member which is provided with a pressing portion 164*a* that presses the supply tubes 17 and is deformable in a direction to interfere with the supply tubes 17. In other words, the displacement member 164 is provided in such a way as to be capable of advancing and retracting to and from the supply tubes 17. The receiving member 163 is a member for receiving the displacement member 164 that is displaced in the direction to interfere with the supply tubes 17, and includes a contact portion 163*a*. In the meantime, a first biasing member 170 biases the receiving member 163 toward the holding member 169. The receiving member 163 is provided on an opposite side to a portion provided with the displacement member 164 in light of the supply tubes 17. Moreover, the pressing portion 164*a* of the displacement member 164 presses the supply tubes 17 against the contact portion 163*a* of the receiving member 163 and crushes the supply tubes 17, thereby closing the ink supply channels 51. Thus, the on-off valve mechanism 160 goes into the close state. The displacement member 164 including the pressing portion 164*a* will be hereinafter referred to as a valve mechanism or more simply as a valve. The displacement member 164 is biased toward the cam 165 by using a second biasing member 171.

As shown in FIGS. 8 to 10C, the cam 165 includes a cam surface 165*a* and a cam shaft 165*b*. The cam 165 is rotated by being engaged with the operating unit 161, thus displacing the displacement member 164. In the case of the present embodiment, the cam 165 is provided separately from the operating unit 161 as shown in FIGS. 10A to 10C. Instead, the cam 165 and the operating unit 161 may be integrated with each other. As shown in FIGS. 9A and 9B, the cam 165 is configured such that the cam surface 165*a* comes into contact with the displacement member 164. In the case where the user operates the operating unit 161, the cam 165 is rotated around the cam shaft 165*b* along with the operation, and the displacement member 164 pushed by the cam surface 165*a* is displaced accordingly. In this way, the user can close or establish communication of the ink supply channels 51 through the operating unit 161.

As shown in FIG. 8, the driving mechanism 260 includes a driving mechanism holding unit 261, a drive transmission gear 262 which is a drive transmission unit to transmit the drive to the operating unit 161, an intermediate gear train 263, and a motor 265. The driving mechanism holding unit 261 includes the drive transmission gear 262, the intermediate gear train 263, and the motor 265. The motor 265 includes a motor gear 264. The drive transmission gear 262 is engaged with the operating unit 161. A driving force is transmitted from the motor 265 connected to the external power supply (not shown) to the drive transmission gear 262 through the intermediate gear train 263, which rotates the operating unit 161 engaged therewith. Thus, it is possible to close and establish communication of the ink supply channels 51 automatically by displacing the displacement member with the cam 165. Here, it is possible to control a direction of drive transmission in one direction from the motor 265 side to the operating unit 161 side by using a worm gear for the motor gear 264 as in the present embodiment. However, the motor gear 264 is not limited only to the worm gear and other publicly known gears may be used instead.

Next, a description will be given of an operation by the on-off valve mechanism 160 according to the present embodiment to close each supply tube 17. FIG. 9A shows the state (the open state) in which the displacement member 164 does not crush the supply tube 17 and the ink supply channel 51 establishes communication. In this open state, the ink in the supply tube 17 can be supplied from the ink tank 11 to the print head 62 through the ink supply channel 51. In this instance, the operating surface 161*a* of the operating unit 161 is located on the side indicated with the print mark 166 as shown in FIG. 7A. The user conducts a rotating operation of the operating unit 161 by accessing the operating surface 161*a* with a finger. Alternatively, the rotating operation of the operating unit 161 is carried out automatically as discussed earlier. The rotating operation is conducted either manually or automatically such that the operating surface 161*a* of the operating unit 161 in the open state is rotated to the side indicated with the maintenance mark 167 as shown in FIG. 7B. Then, the cam surface 165*a* of the cam 165 provided in such a way as to be rotated in response to the rotating operation of the operating unit 161 is also rotated as shown in FIG. 9B. Thereafter, the cam surface 165*a* displaces the displacement member 164 in the direction to interfere with the supply tube 17.

FIG. 9B shows the state (the close state) in which the displacement member 164 crushes the supply tube 17 and the ink supply channel 51 is closed. As shown in FIG. 9B, the supply tube 17 is crushed between the displacement member 164 and the receiving member 163 whereby the ink supply channel 51 is closed. In this instance, the supply tube 17 is in a state of being unable to supply the ink in the ink tank 11 to the print head 62 and in a state of not permitting the flow of the air therein. As a consequence, the ink is not supplied from the ink tank 11 to the print head 62. Accordingly, the user can perform an operation to replace the print head 62, an operation to transport the printing apparatus 100, and the like in the state of suppressing the movement of the ink in the ink supply channel 51. Meanwhile, it is possible to carry out initial filling of the print head 62 with the ink, an operation to remove bubbles from the ink supply channel 51, and the like efficiently by conducting the above-described suctioning operation in the close state of the ink supply channel 51 with the on-off valve mechanism 160.

Here, as shown in FIGS. 10C and 11, the present embodiment provides a plurality of the receiving members 163 corresponding to the supply tubes 17 for the respective ink colors, and also provides a plurality of the contact portions 163*a* corresponding to the supply tubes 17 for the respective ink colors. In the present embodiment, the single common member is provided as the displacement member 164. Meanwhile, two pressing portions 164*a* on the black side (BL) and the color side (CL) are provided as shown in FIG. 11. Moreover, it is possible to close the ink supply channels 51 individually by causing the contact portions 163*a* of the respective supply tubes 17 and the pressing portions 164*a* of the displacement member 164 to crush the respective supply tubes 17 individually. As described above, the present embodiment is configured to close both the black on-off valve mechanism 160 and the color on-off valve mechanism 160 by displacing the displacement member 164 in the direction to interfere with the supply tubes 17. However, the present invention is not limited only to this configuration. Meanwhile, the present embodiment describes the example in which the cam 165 that displaces the displacement member 164 and the operating unit 161 for rotating the cam 165 use the single member in common for the black ink and the color inks. However, the present invention is not limited only this configuration. The above-described members constituting the on-off valve mechanism 160 may be appropriately prepared to form the on-off valve mechanisms 160 for the respective ink colors. Alternatively, the common on-off valve mechanism 160 may be provided for all the colors.

Meanwhile, as shown in FIGS. 9A and 9B, the on-off valve mechanism 160 is provided with an on-off valve sensor 168 for detecting whether the on-off valve mechanism 160 is in the open state or in the close state. In the present embodiment, the on-off valve sensor 168 is an optical sensor that is activated in a contactless manner. In the case where the operating unit 161 is operated manually or automatically, a detection target portion 164*b* provided to the displacement member 164 passes by a detection unit of the on-off valve sensor 168 and the on-off valve sensor 168 is activated. Thus, the on-off valve sensor 168 can detect the close state and the open state of the on-off valve mechanism 160. Here, the on-off valve sensor 168 may adopt a contact sensor or any other publicly known structures instead. For example, the on-off valve sensor 168 may adopt a magnetic sensor, a leaf switch, and the like. Meanwhile, in the case where a plurality of the displacement members are provided, the detection target portions 164*b* may be provided as many as the number of the displacement members.

In the meantime, a variety of control may be carried out by interlocking the on-off valve sensor 168 and the cover sensor 18. For example, there may be a case in which the cover sensor 18 detects the open state of the third cover member 41 and then the on-off valve sensor 168 detects the close state in a case of detection of the close state of the third cover member 41. This may possibly be the case where the close state is brought about by the manual operation of the user, for instance. In this case, the printing apparatus 100 may be used in the close state of the supply tube 17. Accordingly, error notification may be displayed on an operation display unit 611 or a variety of initialization processing may be carried out.

<On-Off Valve Sensor>

Next, a description will be given of details of an operation of the on-off valve sensor 168 to detect the detection target portion 164*b*. As mentioned above, in the case of suppressing an ink leakage as in the printing apparatus 100 of the present embodiment by pressing and closing the supply tube 17 with the pressing portion 164*a* of the displacement member 164 during the transportation, the printing apparatus 100 is presumably kept unused for a long time as in a case of moving, for instance. In this situation, the supply tube 17 may possibly be kept crushed by the displacement member 164 for a long time. Moreover, in the case where the supply tube 17 adopts the flexible material such as an elastomer as in the present embodiment, the supply tube 17 may stick to the displacement member 164 if the supply tube 17 remains pressed by the displacement member 164 for a long time.

Figure 12:
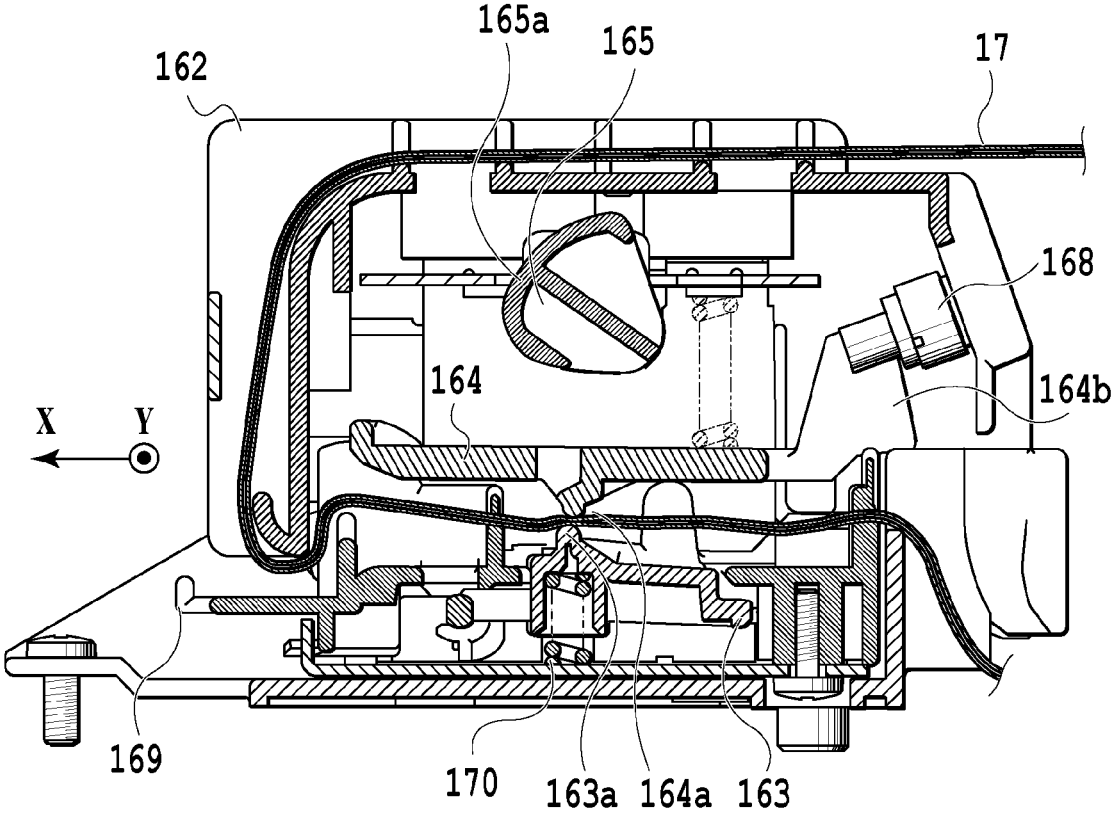
FIG. 12 is a cross-sectional view showing the on-off valve mechanism in a sticking state.

FIG. 12 is a cross-sectional view of the on-off valve mechanism 160 in a sticking state. FIG. 12 is a view illustrating a state where the cam 165 is rotated to the position in the open state shown in FIG. 9A after maintaining the close state in FIG. 9B for a long time. As shown in FIG. 12, it takes time for the recovery of the displacement member 164 depending on the degree of sticking by using only a spring force of the second biasing member 171 biasing against the cam 165. As a consequence, the displacement member 164 may fail to follow the cam 165 and the cam 165 may be detached from the displacement member 164. Here, in case of a mode of providing the driving shaft with the detection target portion (the sensor flag), the sensor flag is detected in a normal manner at a time point of rotating the cam 165 to a predetermined position, and an opening operation will therefore be regarded as being complete. However, there may be a case of causing a failure to normally supply the ink in an ink supplying operation because the tube is actually in the close state.

In the meantime, according to the on-off valve mechanism 160 of the present embodiment, the detection target portion 164*b* is provided to the displacement member 164 that is displaced by a driving operation using the driving shaft (the cam shaft 165*b*). Accordingly, even in the case of developing the sticking, the on-off valve sensor 168 detects that the detection target portion 164*b* is in the close state as shown in FIG. 12. For this reason, it is possible to suppress an erroneous detection of the open and close states such as detection of the open state despite of being actually in the close state.

Meanwhile, the present embodiment is configured to control the cam 165 (the driving shaft) in such a way as to be rotated by a predetermined amount. Such a predetermined amount of rotation is equivalent to an act of drive control for a certain driving amount sufficient for opening the valve, for example. In this way, it is possible to appropriately detect the position of the displacement member 164 with the on-off valve sensor 168 and to confirm that the supply tube 17 is not closed.

Note that the on-off valve mechanism 160 of the present embodiment cannot detect a phase of the cam 165 since the driving shaft is not provided with the detection target portion. In other words, although the on-off valve mechanism 160 can control the driving amount, the on-off valve mechanism 160 cannot detect where the rotational position of the cam 165 as a consequence of the drive is. For this reason, by repeating the rotation of the cam 165 for a certain driving amount, the cam 165 is expected to be located at the position to open the valve. Moreover, in many cases, the sticking is resolved after a lapse of a predetermined period after releasing the pressure. Given the circumstances, the present embodiment is configured to determine whether the valve mechanism is in the open state or in the close state by detecting the position of the displacement member 164 after a lapse of a predetermined standby period following completion of the operation to rotate the cam 165 by the predetermined amount.

Meanwhile, it is possible to reduce a frequency of erroneous termination of a valve opening operation by implementing a scheme of retrying the detection after a lapse of the predetermined standby period for a predetermined number of times. At the time of retry, the predetermined amount of rotation may be changed from that in the first detection. For example, the predetermined amount of rotation in the first detection after starting to drive the driving shaft may be set to such an amount of rotation to locate the cam 165 from the position in FIG. 9B to the position in FIG. 9A, and the amount of rotation at the retry in the second detection and so on may be set to an amount of rotation which is ½ or ⅓ as much as the amount of rotation in the first detection. Here, at the time of retry for the predetermined number of times, the cam 165 may further be rotated clockwise from the position in FIG. 9A, for instance, whereby the cam 165 may be stopped at the position to press the supply tube 17 depending on the phase of the predetermined amount of rotation. However, the predetermined standby period is significantly shorter than the time spent for the long-term storage or for the transportation, and therefore does not affect the sticking. On the other hand, if the open state of the valve is detected as a consequence of the retry as described above, the phase of the cam 165 may not be located at an appropriate position as mentioned earlier. Accordingly, the cam 165 may be once shifted to the close state and then the cam 165 may be rotated to the position corresponding to the open state again. Specifically, after the on-off valve sensor 168 detects the open state of the valve (or in other words, after confirmation of resolving the sticking), the cam 165 is once rotated to the closed position of the valve. Then, based on that position, the cam 165 is rotated to the position to establish the open position of the valve. Thus, it is possible to perform the control in such a way as to maintain the appropriate phase of the cam 165.

Meanwhile, in the present embodiment, an in-operation flag for the valve is stored in the ROM 602 at the start of drive of a driving source in preparation for an event of unexpected power-off during a valve opening sequence. The in-operation flag is a flag (a data bit) that indicates whether or not the valve opening sequence is being executed. Then, the valve opening sequence is carried out in the course of an initialization sequence in the case where the in-operation flag is on, or the valve opening sequence is omitted in the case where the in-operation flag is off. In this way, it is also possible to improve usability by curtailing an operation time period due to unnecessary valve opening sequence operations and enhancing durability associated with reduction in the number of times of the operations.

Figure 13:
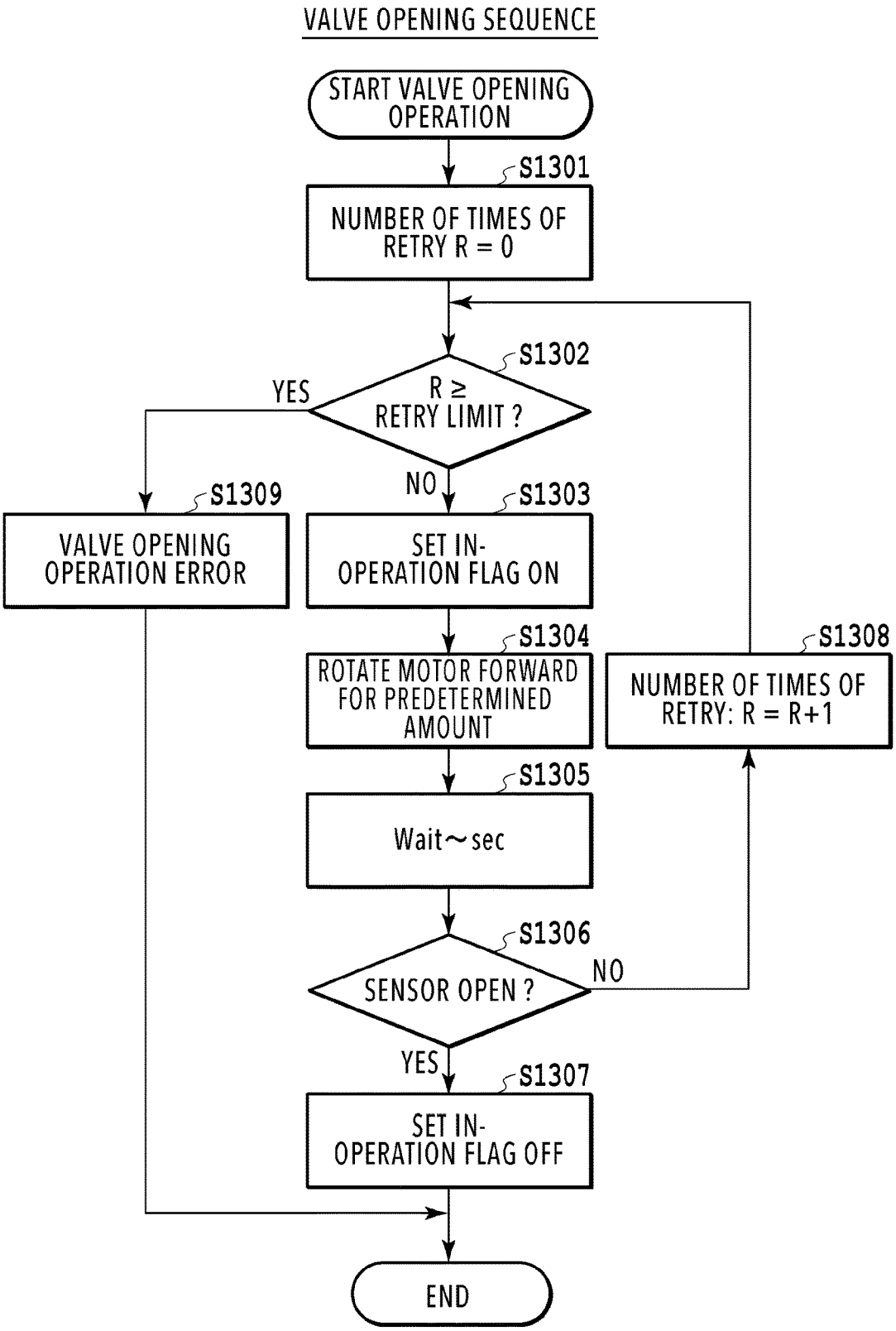
FIG. 13 is a diagram showing an example of a valve opening sequence.

FIG. 13 is a diagram showing an example of the valve opening sequence of the present embodiment. The processing shown in FIG. 13 is realized by causing the MPU 601 to carry out a program stored in the ROM 602. The processing in FIG. 13 is executed in the case where the MPU 601 accepts an instruction to set the on-off valve mechanism 160 to the open state.

In S1301, the MPU 601 initializes the number of times of retry R stored in the RAM 603 to "0".

In S1302, the MPU 601 determines whether or not the number of times of retry R exceeds a predetermined number of times, or in other words, a retry limit. The processing proceeds to S1309 in the case of exceeding the retry limit, where the valve opening operation turns out to be a valve opening operation error and the processing is terminated. The ink cannot be supplied to the print head 62 in the case of the valve opening operation error. Hence, fault processing and error control take place. On the other hand, the processing proceeds to S1303 in the case where the number of times of retry R falls below the predetermined number of times.

In S1303, the MPU 601 sets the in-operation flag in the ROM 602 on. Then, the processing proceeds to S1304 where the MPU 601 drives the cam 165 by driving the motor 265 serving as the driving source for a predetermined amount. Thus, the cam 165 is retracted from the position to press the displacement member 164. Thereafter, in S1305, the MPU 601 waits for a waiting period being a predetermined period to stand by for detachment of the displacement member 164 from the supply tube 17. Subsequently, in S1306, the MPU 601 detects whether or not the on-off valve sensor 168 is in the open state. Specifically, the MPU 601 obtains a detection result of the on-off valve sensor 168 after a lapse of the predetermined standby period. If the detection result of the on-off valve sensor 168 turns out to be the open state, the displacement member 164 is not sticking and the closure of the tube is deemed to be recovered. Hence, the processing proceeds to S1307 where the MPU 601 sets the in-operation flag off and terminates the operation. In this instance, the cam 165 may be once rotated to the position to press the displacement member 164 and then the cam 165 may be rotated based on this position to such a position to set the valve to the open position as described above.

On the other hand, the processing proceeds to S1308 in the case where the on-off valve sensor 168 is determined not to be in the open state, or in other words, to be in the close state in S1306. In S1308, the MPU 601 increments the number of times of retry R by one. Then, the MPU 601 returns to S1302 and repeats the processing.

Here, the waiting period may be set to a predetermined value. Alternatively, the waiting period may be determined based on one of values of various parameters or a combination thereof. Then, the waiting period may be rendered variable depending on a state of use of the printing apparatus 100. Examples of the parameters include an elapsed time from the point of closure of the valve if the printing apparatus 100 is provided with a timer, an air temperature at the time of use if the printing apparatus 100 is provided with a temperature sensor, a humidity at the time of use if the printing apparatus 100 is provided with a humidity sensor, a cumulative total number of printed sheets, and the like. In addition, it is also possible to apply various other parameters having impacts on the sticking performances. If the waiting period is not provided, the cam 165 (the driving shaft) will be continuously operated so as to move to the open position, the closed position, the open position, the closed position, and so forth. Here, the driving operations equivalent to the number of times to retry will be finished without fulfilling the detachment at the open position. As a consequence, the valve opening error may occur as mentioned earlier. According to the present embodiment, it is possible to stand by for the detachment of the closed supply tube 17 by providing the waiting period.

Figure 14:
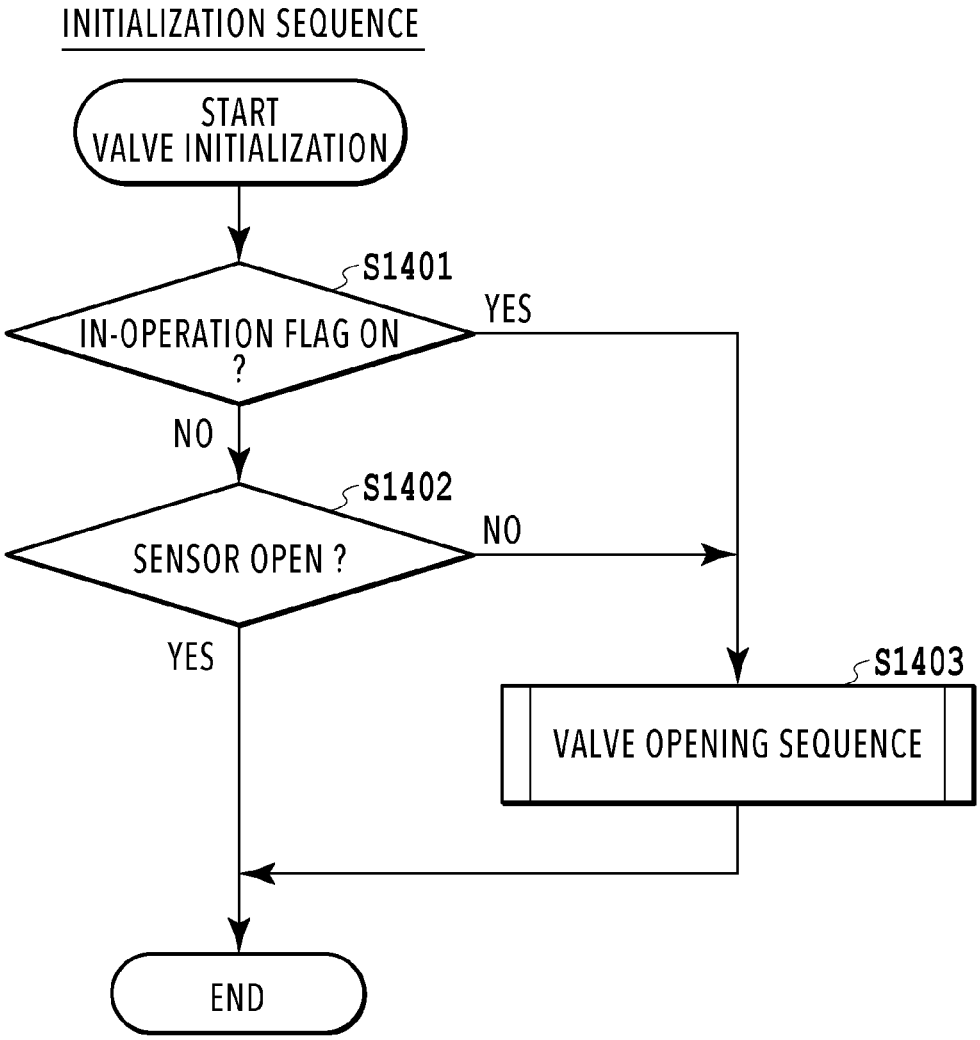
FIG. 14 is a diagram showing a valve initialization operation sequence.

FIG. 14 is a diagram showing a valve initialization operation sequence included in an initialization sequence of the printing apparatus 100. The processing in FIG. 14 is also carried out by causing the MPU 601 to execute a program stored in the ROM 602. At the time of execution of the initialization sequence of the printing apparatus 100, the MPU 601 determines whether or not the in-operation flag is on in S1401. In the case where the in-operation flag is on, the processing proceeds to S1403 where the MPU 601 carries out a valve opening sequence. The processing in S1403 corresponds to the processing in FIG. 13.

After setting the in-operation flag on in S1303 in FIG. 13, unexpected power-off such as blackout may occur before setting the in-operation off in S1307. In this case, the in-operation flag written in the ROM 602 being the non-volatile memory remains therein in the on state. Accordingly, in this case, the valve opening sequence in S1403 will be carried out due to the determination in S1401 in the initialization operation triggered by turning on the power next time. On the other hand, the in-operation flag is off in the case where the valve opening operation has been completed or in the case where the valve opening operation does not take place at the moment. For this reason, the determination in S1401 turns out to be no and the processing proceeds to S1402. In S1402, the MPU 601 determines whether or not the on-off valve sensor 168 is in the open state. In the case where the on-off valve sensor 168 is not in the open state, the processing proceeds to S1403 and the valve opening sequence is carried out. On the other hand, the valve opening sequence is skipped in the case where the on-off valve sensor 168 is in the open state. Thus, it is possible to perform the control in such a way not to execute an unnecessary operation.

As described above, in the present embodiment, the detection target portion 164*b* is provided to the displacement member 164 for pressing the supply tube 17 instead of providing the detection target portion to the driving shaft. Thus, the on-off valve sensor 168 is configured to detect the position of the detection target portion 164*b*. This makes it possible to appropriately detect the state of pressing the supply tube 17. As a consequence, it is possible to avoid the occurrence of an error such as an ink filling failure. Moreover, the operation to detect the on-off valve sensor 168 is carried out after the lapse of the predetermined waiting period to stand by for the detachment of the supply tube 17 from the displacement member 164 following the completion of driving the cam 165. In this way, it is possible to complete the valve opening operation without causing error termination even in case of the occurrence of the sticking. Meanwhile, the valve opening sequence is carried out without involving a redundant waiting period by rendering the waiting period variable based on various parameters such as the elapsed time after closing the valve. This makes it possible to improve usability. In the meantime, it is possible to avoid execution of the unnecessary initialization operation by writing the in-operation flag into the non-volatile memory during the opening and closing operations of the valve. This makes it possible to reduce the operation time and to enhance the durability.

Other Embodiments

The above-described embodiment has explained the example in which the displacement member 164 presses the supply tube 17 by being displaced in a direction of pivotal movement in response to the rotation of the cam 165. However, the present invention is not limited only to this configuration. The sticking may occur likewise in other modes as long as the supply tube 17 is pressed by driving the displacement member 164 with the driving source. In this context, a driving direction of the displacement member may be a direction of linear movement instead of the direction of pivotal movement.

Meanwhile, the above-described embodiment has explained the example in which the displacement member 164 presses the supply tubes 17. However, the present embodiment is applicable to any other modes as long as it is a mode in which a flow channel is closed by pressing a tube with a pressing portion. For instance, the present invention is also applicable to a mode of using a pressing portion to press a tube that is connected to a pump to be used in a recovery operation. In other words, the valve mechanism described in the present embodiment is applicable to tubes for various flow channels.

Meanwhile, the above-described embodiment has explained the example of the printing apparatus that performs printing by using the inks. Instead, in a liquid transfer apparatus configured to transfer a liquid stored in a first reservoir unit to a second reservoir unit may carry out opening and closing of a transfer flow channel therein in the same manner as the above-described embodiment.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2021-020360, filed Feb. 12, 2021, which is hereby incorporated by reference wherein in its entirety.

What is claimed is:

1. A liquid ejecting apparatus comprising:

a tube configured to establish communication of a flow channel by connecting an ejecting portion configured to eject a liquid to an ejection target medium to a container configured to contain the liquid to be supplied to the ejecting portion;

a valve mechanism configured to switch between a close state of pressing and closing the tube and an open state of opening the tube depending on a rotational position of a cam member configured to be rotated by a driving source; and a detection unit configured to detect whether the valve mechanism is in the close state or in the open state, wherein the valve mechanism includes a detection target portion, and the detection unit detects whether the valve mechanism is in the close state or in the open state by detecting the detection target portion.

2. The liquid ejecting apparatus according to claim 1, further comprising:

a control unit configured to control opening and closing of the valve mechanism by controlling an operation to drive the driving source, and to obtain a detection result from the detection unit.

3. The liquid ejecting apparatus according to claim 2, wherein the control unit performs an operation to drive the driving source by a predetermined amount in a direction to open the valve mechanism in a case of opening the valve mechanism, and the control unit obtains the detection result from the detection unit after a lapse of a predetermined standby period following completion of the operation to drive the driving source.

4. The liquid ejecting apparatus according to claim 3, wherein the predetermined standby period is variable and is determined depending on a state of use of the liquid ejecting apparatus.

5. The liquid ejecting apparatus according to claim 4, wherein the state of use is based on at least one of an elapsed time from a point of the valve mechanism turned into the close state, an air temperature, a humidity, and a cumulative total number of printed sheets printed on ejection target media.

6. The liquid ejecting apparatus according to claim 3, wherein the control unit repeats a set of the operation to drive the driving source and obtainment of a detection result by the detection unit after a lapse of the predetermined standby period for a predetermined number of times in a case where the detection result by the detection unit after the lapse of the predetermined standby period turns out to be the close state.

7. The liquid ejecting apparatus according to claim 6, wherein the control unit performs error control in a case where the detection result by the detection unit after repeating the set for the predetermined number of times turns out to be the close state.

8. The liquid ejecting apparatus according to claim 3, wherein the predetermined amount of the operation to drive the driving source for a first time after starting the drive of the driving source is different from the predetermined amount of the operation to drive the driving source for a second time or subsequent time.

9. The liquid ejecting apparatus according to claim 2, further comprising:

a non-volatile memory, wherein the control unit sets a flag on and writes the flag into the non-volatile memory at a start of driving the driving source, the flag indicating that an operation to open the valve mechanism is being executed, the control unit sets the flag off and writes the flag into the non-volatile memory in a case where the detection result by the detection unit indicates the open state, and the control unit does not execute initialization processing of the valve mechanism in a case where the flag is off at time of executing an initialization operation of the liquid ejecting apparatus.

10. The liquid ejecting apparatus according to claim 9, wherein the control unit executes the initialization processing to establish the open state of the valve mechanism in a case where the flag is on at the time of executing the initialization operation of the liquid ejecting apparatus.

11. The liquid ejecting apparatus according to claim 1, wherein the detection unit is any of an optical sensor, a magnetic sensor, and a leaf switch.

12. The liquid ejecting apparatus according to claim 1, wherein a driving direction of the valve mechanism is any of a direction of pivotal movement and a direction of linear movement.

13. The liquid ejecting apparatus according to claim 1, wherein the ejecting portion is a print head configured to eject an ink.

14. The liquid ejecting apparatus according to claim 1, wherein the tube is the tube connected to a pump to be used in a recovery operation.

15. A method of controlling a liquid ejecting apparatus including a tube configured to establish communication of a flow channel by connecting an ejecting portion configured to eject a liquid to an ejection target medium to a container configured to contain the liquid to be supplied to the ejecting portion, a valve mechanism configured to switch between a close state of pressing and closing the tube and an open state of opening the tube depending on a rotational position of a cam member configured to be driven by a driving source, and a detection unit configured to detect whether the valve mechanism is in the close state or in the open state, the method comprising:

driving the driving source by a predetermined amount in a case of opening the valve mechanism;

waiting for a predetermined standby period after driving the driving source; and obtaining a detection result of detection of a detection target portion provided to the valve mechanism by the detection unit after a lapse of the predetermined standby period.

16. A liquid transfer apparatus comprising:

a tube configured to form a flow channel to transfer a liquid;

a valve mechanism configured to switch between a close state of pressing and closing the tube and an open state of opening the tube depending on a rotational position of a cam member configured to be rotated by a driving source; and a detection unit configured to detect whether the valve mechanism is in the close state or in the open state, wherein the valve mechanism includes a detection target portion, and the detection unit detects whether the valve mechanism is in the close state or in the open state by detecting the detection target portion.

17. A method of controlling a liquid transfer apparatus including a tube configured to form a flow channel to transfer a liquid, a valve mechanism configured to switch between a close state of pressing and closing the tube and an open state of opening the tube depending on a rotational position of a cam member configured to be rotated by a driving source, and a detection unit configured to detect whether the valve mechanism is in the close state or in the open state, the method comprising:

driving the driving source by a predetermined amount in a case of opening the valve mechanism;

waiting for a predetermined standby period after completion of driving the driving source; and obtaining a detection result of detection of a detection target portion provided to the valve mechanism by the detection unit after a lapse of the predetermined standby period.

* * * * *